US010505290B2

(12) United States Patent
Kuroiwa et al.

(10) Patent No.: US 10,505,290 B2
(45) Date of Patent: Dec. 10, 2019

(54) TERMINAL AND HARNESS

(71) Applicant: Japan Aviation Electronics Industry, Limited, Tokyo (JP)

(72) Inventors: Masakazu Kuroiwa, Tokyo (JP); Hiroaki Obikane, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 16/227,403

(22) Filed: Dec. 20, 2018

(65) Prior Publication Data

US 2019/0267726 A1 Aug. 29, 2019

(30) Foreign Application Priority Data

Feb. 28, 2018 (JP) ..... 2018-034532

(51) Int. Cl.

| | |
|---|---|
| ***H01R 4/24*** | (2018.01) |
| ***H01R 4/48*** | (2006.01) |
| ***H01R 11/11*** | (2006.01) |
| ***H01R 4/26*** | (2006.01) |
| *H01R 13/11* | (2006.01) |

(52) U.S. Cl.

CPC ..... *H01R 4/48* (2013.01); *H01R 4/26* (2013.01); *H01R 11/11* (2013.01); *H01R 13/11* (2013.01)

(58) Field of Classification Search

CPC ..... H01R 4/2429; H01R 4/2433
USPC ..... 439/395–400, 409, 410
See application file for complete search history.

(56) References Cited

U.S. PATENT DOCUMENTS 3,926,498 A * 12/1975 Hoppe, Jr. ..... H01R 13/28 439/400
4,050,760 A 9/1977 Cohen
(Continued)

FOREIGN PATENT DOCUMENTS

DE 101 52 519 A1 5/2003
DE 10 2012 100166 A1 7/2013
(Continued)

OTHER PUBLICATIONS

Extended European Search Report in EP 19152324.0-1201, dated May 31, 2019.
(Continued)

*Primary Examiner* — Neil Abrams
(74) *Attorney, Agent, or Firm* — Collard & Roe, P.C.

(57) ABSTRACT

A wire connection portion of a terminal has a first part and a second part. The first part has two first sidewall portions and a first coupling portion coupling them. The first sidewall portions are located apart from each other in a lateral direction. The second part has two second sidewall portions and a second coupling portion coupling them. The second sidewall portions are located apart from each other and outside the first sidewall portions, respectively, in the lateral direction. The first coupling portion is located apart from the second coupling portion in an up-down direction. The first sidewall portions are provided with contact portions, respectively, to be brought into contact with an electrical wire. When the electrical wire is connected to the terminal, the contact portions sandwich the electrical wire in the lateral direction. The contact portions may be rounded to press on sides of a bare wire placed in the device.

10 Claims, 8 Drawing Sheets

(56) References Cited

U.S. PATENT DOCUMENTS

| | | | | |
|---|---|---|---|---|
| 4,472,596 | A * | 9/1984 | Brown | H01R 4/2429 174/840 |
| 4,684,195 | A * | 8/1987 | Anderson | H01R 4/2433 439/404 |
| 4,926,548 | A * | 5/1990 | Hopkins | H01R 4/024 29/860 |
| 5,733,139 | A * | 3/1998 | Bray | H01R 4/2429 439/402 |
| 5,924,887 | A | 7/1999 | Aoyama et al. | |
| 6,435,899 | B2 * | 8/2002 | Kojima | H01R 4/2466 439/395 |
| 8,062,056 | B2 | 11/2011 | Lee | |
| 8,512,066 | B2 * | 8/2013 | Lee | H01R 4/2433 439/395 |
| 8,628,353 | B2 | 1/2014 | Yokoyama | |
| 2006/0166547 | A1 | 7/2006 | Deutmarg et al. | |

FOREIGN PATENT DOCUMENTS

| | | | |
|---|---|---|---|
| JP | S61-053861 | U | 4/1986 |
| JP | H07-282944 | A | 10/1995 |
| JP | H10-162872 | A | 6/1998 |
| JP | 2011-065978 | A | 3/2011 |
| JP | 2012-079652 | A | 4/2012 |

OTHER PUBLICATIONS

Office Action dated Oct. 1, 2019 in European Patent Application No. 19 152 324.0.

* cited by examiner

TERMINAL AND HARNESS

CROSS REFERENCE TO RELATED APPLICATIONS

This application is based on and claims priority under 35 U.S.C. § 119 to Japanese Patent Application No. JP2018-034532 filed Feb. 28, 2018, the contents of which are incorporated herein in their entireties by reference.

BACKGROUND OF THE INVENTION

This invention relates to a terminal and a harness provided with the same.

JP1998-162872A (Patent Document 1) discloses a terminal to be attached to an end of an electrical wire. As shown in FIG. 15, the terminal 95 disclosed in Patent Document 1 has a terminal body 950 and a push-in member 970. The terminal body 950 has a connection portion 952 and a pressure-contact portion 954. The push-in member 970 is formed to be fit in the pressure-contact portion 954. The pressure-contact portion 954 has two sets of pressure-contact blades 956. In detail, the pressure-contact portion 954 has plate portions 957, and edges of the plate portions 957 form the pressure-contact blades 956. The pressure-contact blades 956 of each of the sets face each other at an interval to define a pressure-contact gap 958. The push-in member 970 is formed with pressure-contact gaps 972. The push-in member 970 has a pushed portion 974 at an upper end of each of the pressure-contact gaps 972.

As understood from FIG. 15, the electrical wire 90 is laid above the pressure-contact gaps 958. Pushing the push-in member 970 into the pressure-contact portion 954, the electrical wire 90 is pushed into the pressure-contact gaps 958 and into the pressure-contact gaps 972. Thus, the electrical wire 90 is sandwiched by the pressure-contact portion 954 and the push-in member 970 to be fixed. At this time, the pressure-contact blades 956 break a sheath 904 and bite a core wire 902 to be brought into contact with the core wire 902. As a result, the core wire 902 and the terminal 95 are electrically connected to each other.

SUMMARY OF THE INVENTION

The pressure-contact portion 954 of the terminal 95 of Patent Document 1 has the plate portions 957 perpendicular to a direction in which the electrical wire 90 extends. Therefore, the terminal 95 of Patent Document 1 has a problem that it is difficult to downsize in at least one direction perpendicular to the direction in which the electrical wire 90 extends.

It is an object of the present invention to provide a terminal which can be downsized in comparison with a terminal to be connected to an electrical wire using edges of plate portions and to provide a harness providing such a terminal.

One aspect of the present invention provides a terminal to be connected to an electrical wire. The terminal has a terminal body connectable to a mating terminal and a wire connection portion to be connected to the electrical wire. The wire connection portion is located rearward of the terminal body in a front-rear direction. The wire connection portion has a first part and a second part. The first part has two first sidewall portions and a first coupling portion. The first sidewall portions are located apart from each other in a lateral direction perpendicular to the front-rear direction. The first coupling portion couples the first sidewall portions to each other. The second part has two second sidewall portions and a second coupling portion. The second sidewall portions are located apart from each other in the lateral direction. The second coupling portion couples the second sidewall portions to each other. The second sidewall portions are located outward of the first sidewall portions, respectively, in the lateral direction. The first coupling portion is located apart from the second coupling portion in an up-down direction perpendicular to both of the front-rear direction and the lateral direction. The first sidewall portions are provided with contact portions, respectively, to be brought into contact with the electrical wire. When the electrical wire is connected to the terminal, the contact portions sandwich the electrical wire in the lateral direction.

Another aspect of the present invention provides harness which comprises the terminal and the electrical wire.

In the terminal according to one aspect of the present invention, the first part of the wire connection portion has two of the first sidewall portions, and the second part has two of the second sidewall portions. The first sidewall portions are located apart from each other in the lateral direction, and the second sidewall portions are located outward of the first sidewall portions, respectively, in the lateral direction. The first sidewall portions are provided with contact portions, respectively, and the contact portions sandwich the electrical wire in the lateral direction. According to this structure, plate portions perpendicular to the front-rear direction are unnecessary for connection to the electrical wire. Therefore, the terminal according to one aspect of the present invention can be downsized at least in the lateral direction in comparison with a terminal to be connected to the electrical wire by edges of the plate portions.

An appreciation of the objectives of the present invention and a more complete understanding of its structure may be had by studying the following description of the preferred embodiment and by referring to the accompanying drawings.

Figure 1:
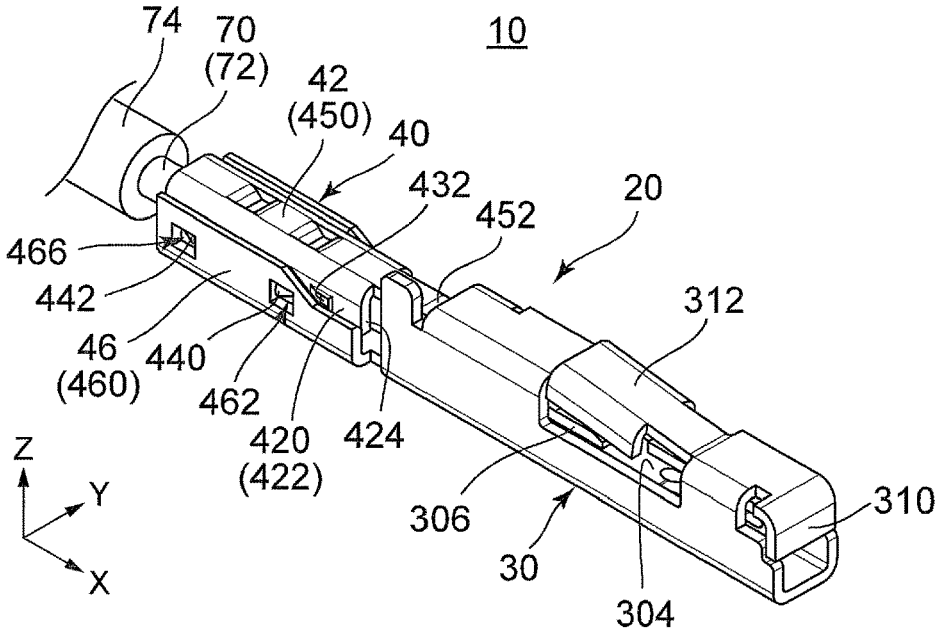
FIG. 1 is a perspective view showing a harness according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Referring to FIG. 1, a harness 10 according to an embodiment of the present invention is provided with a terminal 20 and an electrical wire 70 connected to the terminal 20. The terminal 20 is connected to a tip portion of a core wire 72 of the electrical wire 70. In the present embodiment, the core wire 72 is neither a stranded wire in which electrical wires are twisted together nor a bundle of electrical wires. The core wire 72 of the present embodiment is a single wire having a single electrical wire. As understood from FIG. 1, the tip portion of the core wire 72 is not covered by a sheath 74 but exposed. A front end of the sheath 74 is located rearward of the terminal 20. The terminal 20 has an approximately rectangular parallelepiped shape extending in a front-rear direction. In the present embodiment, the front-rear direction is an X-direction. A positive X-direction is directed forward while a negative X-direction is directed rearward.

Referring to FIGS. 2 to 5, the terminal 20 has a terminal body 30 and a wire connection portion 40. The terminal 20 is made of a single thin metal plate, and the terminal body 30 and the wire connection portion 40 are formed in a single body. The terminal body 30 is a part which is connectable to a mating terminal (not shown) while the wire connection portion 40 is another part to be connected to the electrical wire 70. In the front-rear direction, the terminal body 30 is located forward of the wire connection portion 40 while the wire connection portion 40 is located rearward of the terminal body 30.

Figure 6:
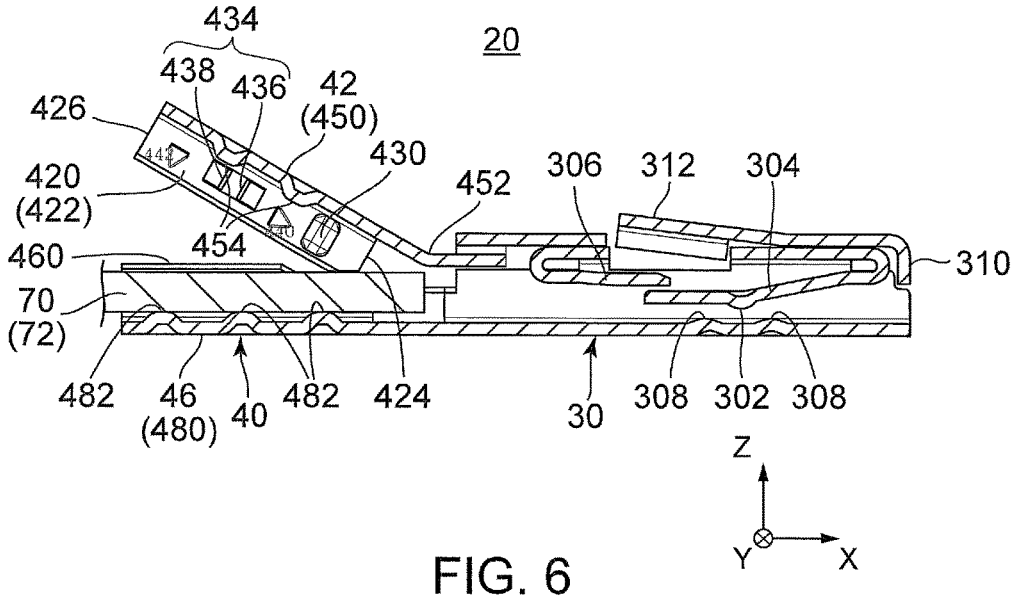
FIG. 6 is a cross-sectional view showing the terminal of FIG. 5, taken along line A-A. A tip portion of a core wire of an electrical wire is disposed inside a second part of the wire connection portion.

As understood from FIGS. 1 and 6, the terminal body 30 is a socket contact which opens forward and which is connectable to and removable from the mating terminal (not shown) in the front-rear direction. In detail, the terminal body 30 is provided with a contact point 302, a support portion 304 supporting the contact point 302 and an assist spring portion 306 assisting the support portion 304. The terminal body 30 is further provided with a plurality of auxiliary contact points 308, a protection portion 310 and a lance 312. However, the present invention is not limited thereto. The terminal body 30 may employ an optional structure. For example, the terminal body 30 may not be provided with one of or both of the assist spring portion 306 and the protection portion 310. Moreover, the terminal body 30 may be formed as a pin contact.

Figure 11:
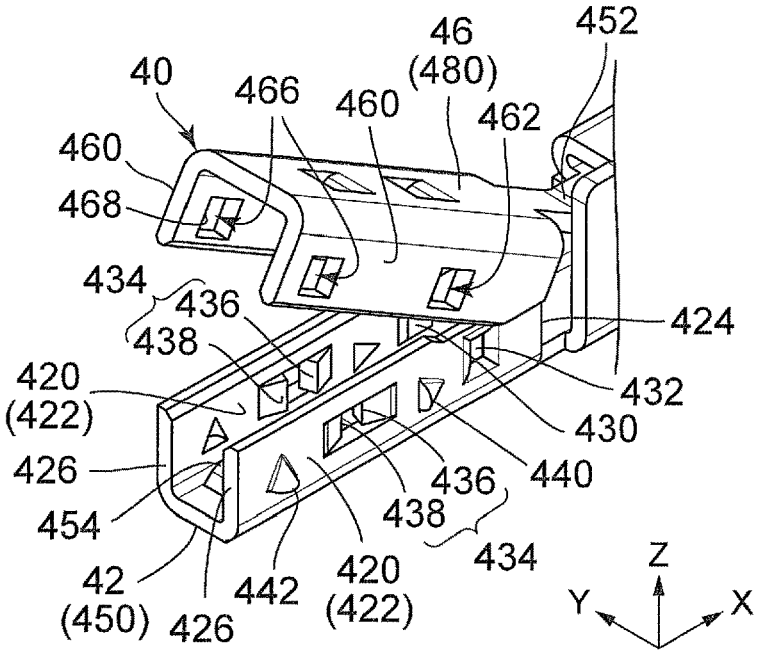
FIG. 11 is a perspective view showing a wire connection portion according to a first modified example of the terminal of FIG. 2.

As shown in FIGS. 2 to 6, the wire connection portion 40 has a first part 42 and a second part 46. The first part 42 is formed to be relatively movable with respect to the second part 46. In detail, the first part 42 has a bending portion 452. As understood from FIGS. 6 to 8, deforming the bending portion 452 allows the first part 42 to be moved relatively with respect to the second part 46. By moving the first part 42 toward the second part 46 and fitting the first part 42 into the second part 46, the wire connection portion 40 comes into a closed state, i.e. a state shown in FIGS. 7 and 8. To the contrary, by separating the first part 42 from the second part 46, the wire connection portion 40 comes into an open state, i.e. a state shown in FIG. 6. However, the present invention is not limited thereto. For example, the first part 42 may be formed to be distinct and separated from the terminal body 30 (and the second part 46). In this case, the first part 42 is also relatively movable with respect to the second part 46. Nevertheless, when the first part 42 and the terminal body 30 are formed into the single body, the terminal 20 is easy to handle owing to a smaller number of parts thereof. Alternatively, as shown in FIG. 11, the second part 46 may be formed to be relatively movable with respect to the first part 42 by interchanging a position of the first part 42 and a position of the second part 46 with each other. At any rate, the wire connection portion 40 can shift between the open state and the closed state by relatively moving one of the first part 42 and the second part 46 with respect to the other.

Figure 2:
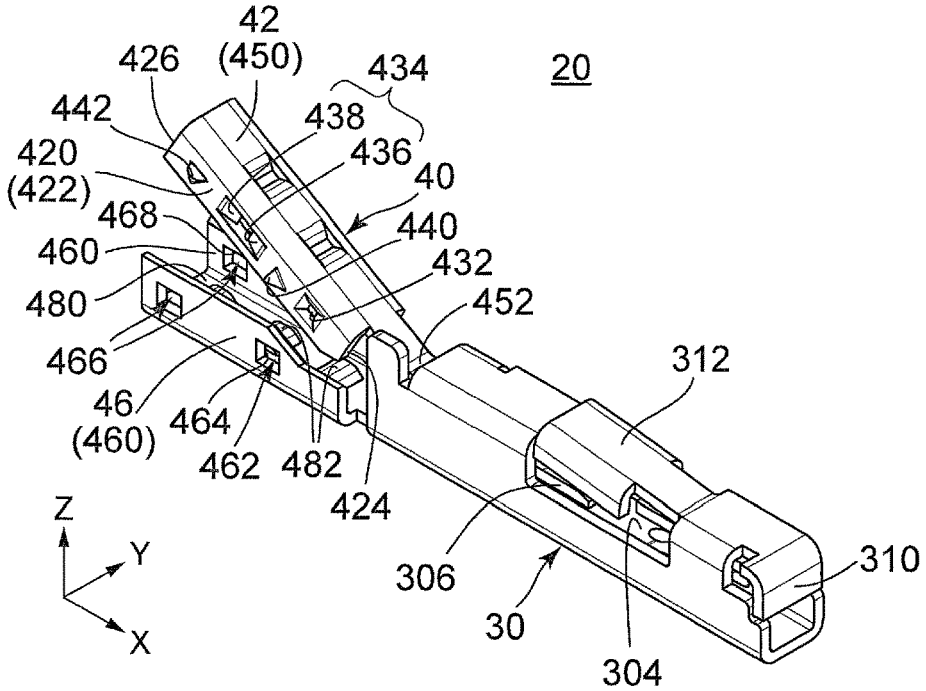
FIG. 2 is a perspective view showing a terminal included in the harness of FIG. 1. A wire connection portion of the terminal opens.
Figure 3:
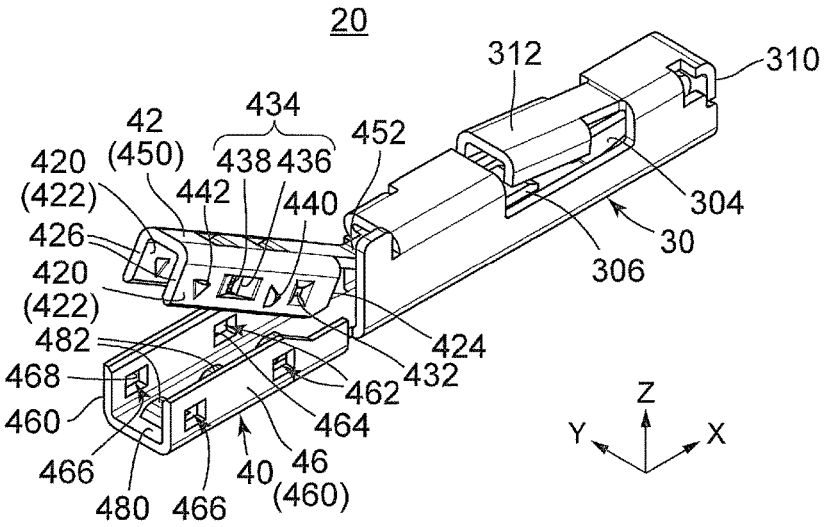
FIG. 3 is another perspective view showing the terminal of FIG. 2.
Figure 4:
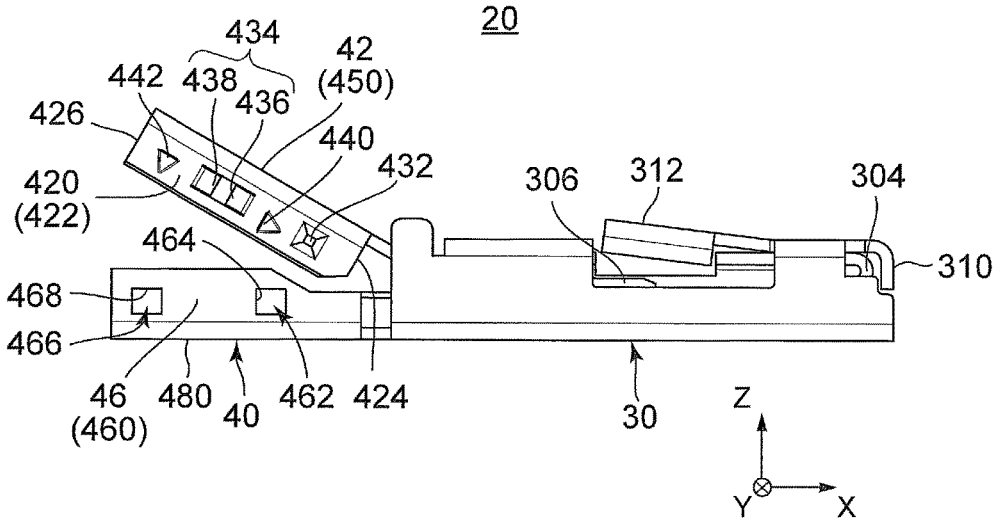
FIG. 4 is a side view showing the terminal of FIG. 2.
Figure 5:
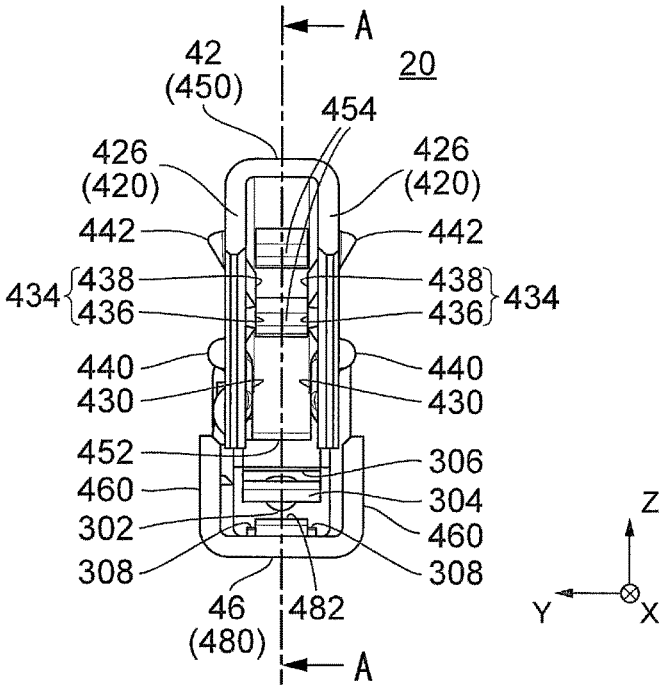
FIG. 5 is a rear view showing the terminal of FIG. 2.

As shown in FIGS. 3 and 5, the first part 42 has two first sidewall portions 420 and a first coupling portion 450. As understood from FIG. 4, each of the first sidewall portions 420 has an approximately rectangular shape long in one direction. As understood from FIGS. 2 to 5, the first sidewall portions 420 are located apart from each other in a lateral direction perpendicular to the front-rear direction. In the present embodiment, the lateral direction is a Y-direction. The first coupling portion 450 couples the first sidewall portions 420 to each other so that the first sidewall portions 420 are parallel to each other. When the first part 42 is viewed along its longitudinal direction, a shape thereof is an inverted U-shape. In detail, as understood from FIG. 9, when the wire connection portion 40 is in the closed state, the first coupling portion 450 is located upward of the first sidewall portions 420 and couples upper edges of the first sidewall portions 420 to each other. Here, an up-down direction is a direction perpendicular to both of the front-rear direction and the lateral direction. In the present embodiment, the up-down direction is a Z-direction. A positive Z-direction is directed upward while a negative Z-direction is directed downward.

As understood from FIGS. 2 to 4, each of the first sidewall portions 420 has a main portion 422 of a flat shape. The main portion 422 has a front end 424 and a rear end 426. As understood from FIGS. 2 to 6, the main portion 422 is provided with a protruding contact portion (a contact portion) 430. The protruding contact portion 430 protrudes inward in the lateral direction. A contact back portion 432 corresponding to the protruding contact portion 430 is dented inward in the lateral direction. However, the present invention is not limited thereto. The contact portion does not need to protrude from the main portion 422. It is sufficient that a part of the main portion 422 can be used as the contact portion. Nevertheless, when at least one of the first sidewall portions 420 is provided with the protruding contact portion 430, the terminal 20 can be stably connected to the electrical wire 70. At any rate, each of the first sidewall portions 420 has the contact portion.

Figure 12:
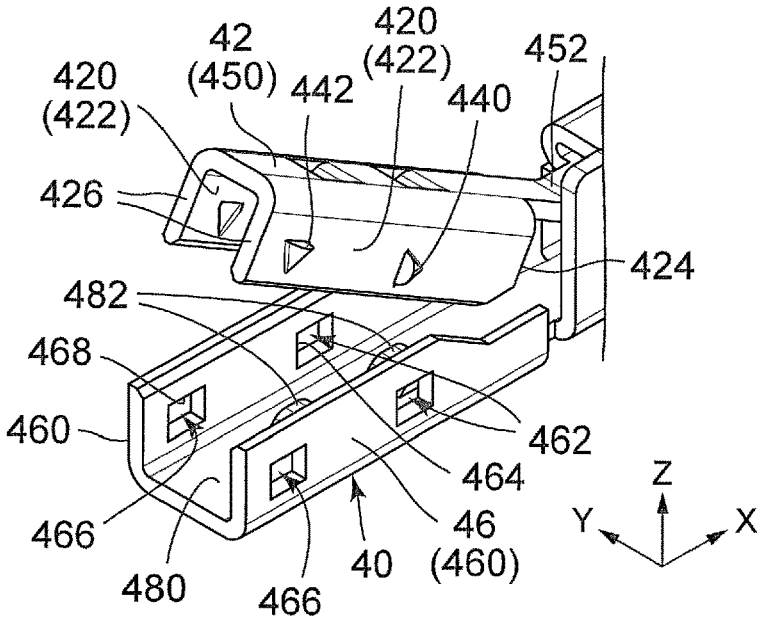
FIG. 12 is a perspective view showing a wire connection portion according to a second modified example of the terminal of FIG. 2.

As shown in FIGS. 2 to 4, the main portion 422 is further provided with a holding portion 434, a first coming-off prevention protrusion 440 and a second coming-off prevention protrusion 442. However, the present invention is not limited thereto. It is sufficient that each of the first sidewall portions 420 is provided with at least the contact portion. For example, as shown in FIG. 12, the first sidewall portion 420 may be merely provided with the first coming-off prevention protrusion 440 and the second coming-off prevention protrusion 442. It should be noted that a part of the main portion 422 is used as the contact portion in this example.

Figure 13:
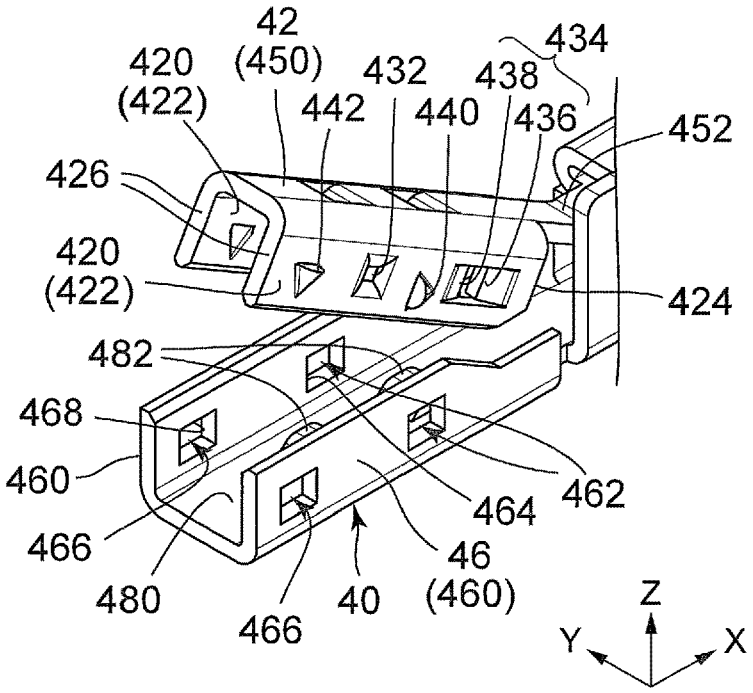
FIG. 13 is a perspective view showing a wire connection portion according to a third modified example of the terminal of FIG. 2.
Figure 14:
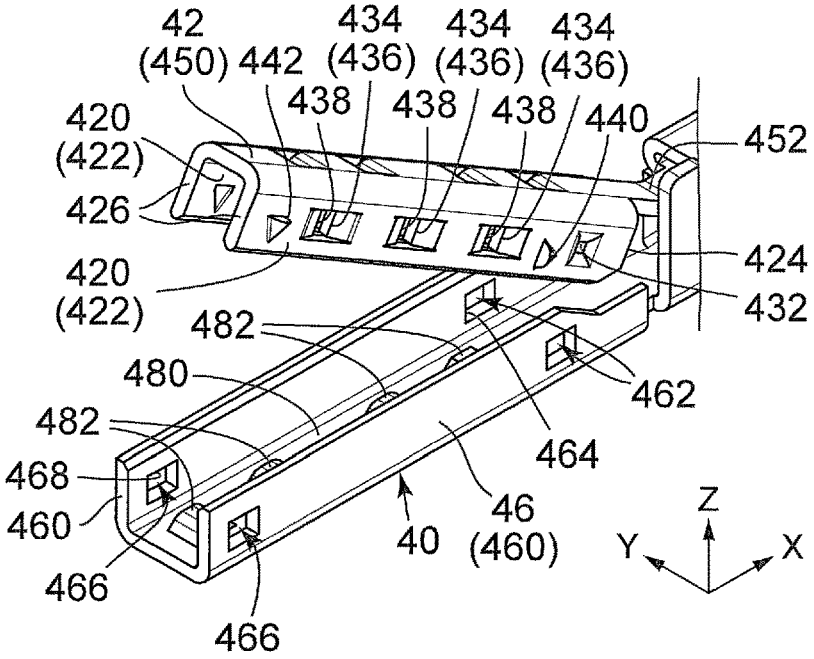
FIG. 14 is a perspective view showing a wire connection portion according to a fourth modified example of the terminal of FIG. 2.
Figure 15:
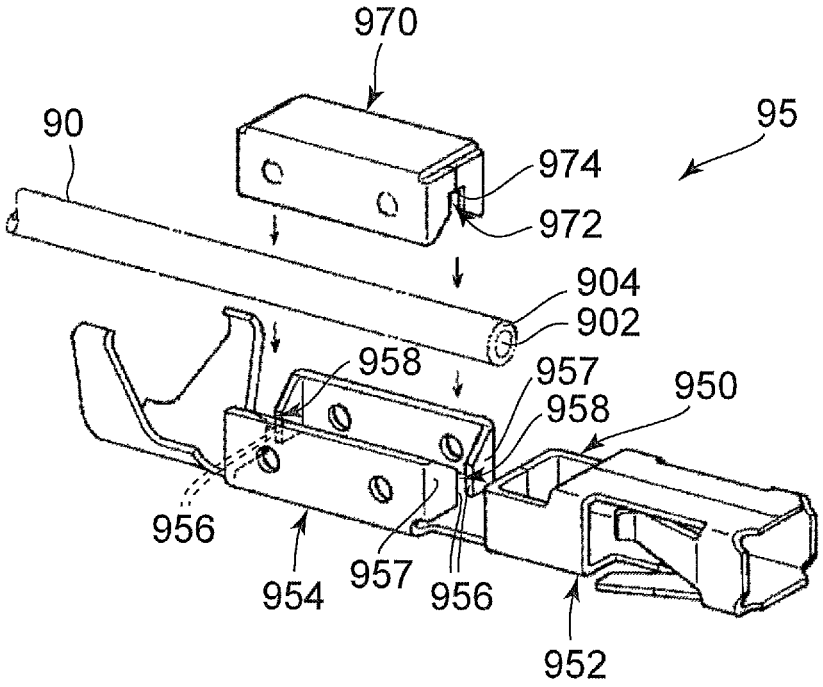
FIG. 15 PRIOR ART
FIG. 15 is an exploded perspective view showing a terminal described in Patent Document 1.

As understood from FIGS. 2 to 6, in the present embodiment, the protruding contact portion 430 (or the contact back portion 432), the holding portion 434, the first coming-off prevention protrusion 440 and the second coming-off prevention protrusion 442 are arranged in this order from the front end 424 toward the rear end 426. However, the present invention is not limited thereto. The numbers and arrangement of the protruding contact portion(s) 430, the holding portion(s) 434, the first coming-off prevention protrusion(s) 440 and the second coming-off prevention protrusion(s) 442 can be changed optionally. For example, as shown in FIG. 13, a position of the protruding contact portion 430 (or the contact back portion 432) and a position of the holding portion 434 may be interchanged with each other. The holding portion 434 decreases a cross-sectional area of the core wire 72. Accordingly, in a case of treating a large current, it is more advantageous that the protruding contact portion 430 is located rearward of the holding portion 434. Nevertheless, when the protruding contact portion 430 is located forward of the holding portion 434, an interval between the protruding contact portion 430 and the mating terminal (not shown) can be shorter. In addition, when the protruding contact portion 430 is located forward of the holding portion 434, a plurality of the holding portions 434 can be provided as shown in FIG. 14. With this provision, a connection state between the terminal 20 and the electrical wire 70 can be more stable.

Figure 9:
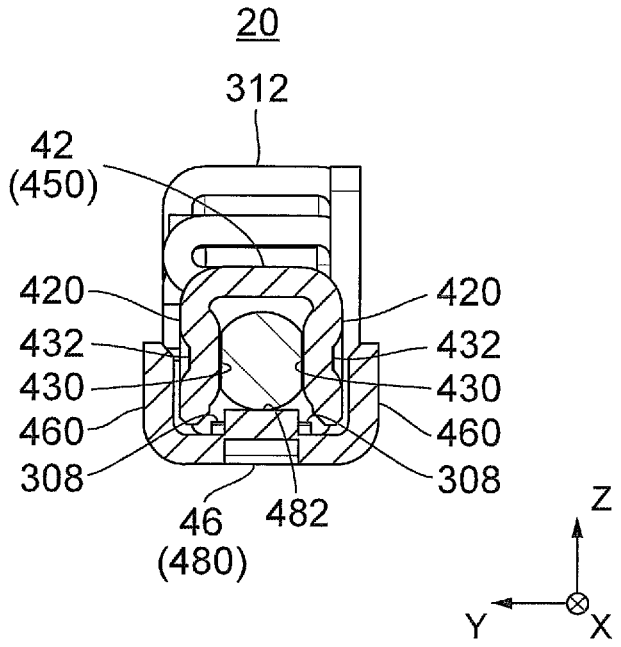
FIG. 9 is a cross-sectional view showing the wire connection portion of FIG. 8, taken along line B-B.
Figure 10:
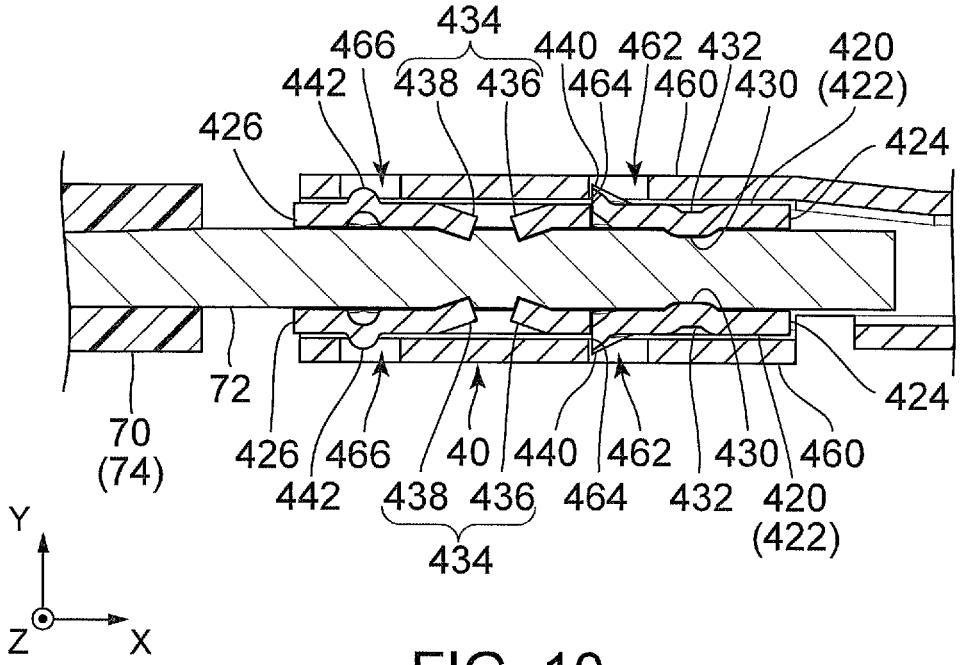
FIG. 10 is a cross-sectional view showing the wire connection portion of FIG. 8, taken along line C-C.

As shown in FIGS. 9 and 10, the protruding contact portions 430 protrude inward from the main portions 422 in the lateral direction. In other words, the protruding contact portions 430 protrude toward each other from the main portions 422. In the present embodiment, the protruding contact portions 430 are formed by metal stamping.

As understood from FIGS. 6 and 9, in the present embodiment, each of the protruding contact portions 430 is a curved surface which is curved, to bulge inward in the lateral direction, with respect to the up-down direction. In other words, the protruding contact portion 430 is curved when viewed along the front-rear direction. Furthermore, as understood from FIGS. 6 and 10, in the present embodiment, each of the protruding contact portions 430 is a curved surface which is curved, to bulge inward in the lateral direction, with respect to the front-rear direction. In other words, the protruding contact portion 430 is curved when viewed along the up-down direction. It should be noted that "a curved surface" of the present embodiment may include a surface which is curbed to have a flat section partially. In particular, a top portion of the protruding contact portion 430 may be flat.

As understood from FIGS. 9 and 10, an interval between the protruding contact portions 430 in the lateral direction is smaller than a diameter of the core wire 72 of the electrical wire 70. Moreover, an interval between the main portions 422 in the lateral direction is equal to or slightly larger than the diameter of the core wire 72. Hence, the tip portion of the core wire 72 can positioned between the main portions 422. In addition, the protruding contact portions 430 can be brought into contact with the core wire 72 positioned between the main portions 422.

As shown in FIGS. 9 and 10, each of the holding portions 434 has a pair of lugs 436 and 438. In the present embodiment, each of the lugs 436 and 438 is formed by cutting and rising slightly a part of the metal plate. The lugs 436 and 438 of the pair are arranged in the front-rear direction, and they extend inward in the lateral direction. In addition, the lug 436 extends rearward diagonally while the lug 438 extends forward diagonally. A tip of the lug 436 and a tip of the lug 438 are apart from each other. When the wire connection portion 40 is in the closed state, the holding portions 434 hold the electrical wire 70. In detail, the tips of the lugs 436 and 438 bite the core wire 72 of the electrical wire 70 and hold the core wire 72. The lugs 436 and 438 prevent the core wire 72 from moving, especially, in the front-rear direction. The lugs 436 and 438 are not for electrical connection. Accordingly, a biting amount of each of the lugs 436 and 438 to the core wire 72 can be smaller in comparison with that of each of the pressure-contact blades of Patent Document 1. In other words, a protruding amount of each of the lugs 436 and 438 from the main portion 422 can be small. Therefore, existence of the lugs 436 and 438 never upsize the terminal 20.

As shown in FIG. 10, the first coming-off prevention protrusions 440 and the second coming-off prevention protrusions 442 protrude outward of the first part 42 from the main portions 422 in the lateral direction. In the present embodiment, the first coming-off prevention protrusions 440 and the second coming-off prevention protrusions 442 are formed by making slits into the metal plate and carrying out metal stamping for the metal plate. As understood from FIGS. 3 and 5, in the present embodiment, each of the first coming-off prevention protrusions 440 and the second coming-off prevention protrusions 442 has a shape like a part of a circular cone. Accordingly, as understood from FIGS. 4, 6 and 8, each of the first coming-off prevention protrusions 440 and the second coming-off prevention protrusions 442 has a shape of a triangle when viewed along the lateral direction. When the wire connection portion 40 is in the closed state, each of the first coming-off prevention protrusions 440 is formed so that one of edges thereof is perpendicular to the front-rear direction. In the present embodiment, a rear edge of the first coming-off prevention protrusion 440 is perpendicular to the front-rear direction. The rear edge of the first coming-off prevention protrusion 440 corresponds to a bottom surface of the circular cone. Accordingly, a protruding amount of the first coming-off prevention protrusion 440 is increased toward the rear edge of the first coming-off prevention protrusion 440. On the other hand, each of the second coming-off prevention protrusions 442 is formed so that one of edges thereof is perpendicular to the up-down direction when the wire connection portion 40 is in the closed state. In the present embodiment, an upper edge of the second coming-off prevention protrusion 442 is perpendicular to the up-down direction. The upper edge of the second coming-off prevention protrusion 442 corresponds to a bottom surface of the circular cone. Accordingly, a protruding amount of the second coming-off prevention protrusion 442 is increased toward the upper edge of the second coming-off prevention protrusion 442.

As shown in FIGS. 2 to 5, the second part 46 has two second sidewall portions 460 and a second coupling portion 480. Each of the second sidewall portions 460 has an approximately rectangular shape long in the front-rear direction. The second sidewall portions 460 are located apart from each other in the lateral direction. The second coupling portion 480 couples the second sidewall portions 460 to each other so that the second sidewall portions 460 are parallel to each other. When the second part 46 is viewed along the front-rear direction, a shape thereof is a U-shape. In other words, the second coupling portion 480 is located downward of the second sidewall portions 460 and couples lower edges of the second sidewall portions 460 to each other. As understood from FIGS. 7 and 9, in the up-down direction, the first coupling portion 450 and the second coupling portion 480 are located apart from each other. When the electrical wire 70 is connected to the wire connection portion 40, the tip portion of the core wire 72 is located between the first coupling portion 450 and the second coupling portion 480 in the up-down direction.

As understood from FIGS. 1, 5 and 9, the second sidewall portions 460 are located outward of the first sidewall portions 420, respectively, in the lateral direction. When the wire connection portion 40 is in the closed state, the first sidewall portions 420 are located between the second sidewall portions 460.

As shown in FIGS. 1 to 4, each of the second sidewall portions 460 is formed with a first receiving portion 462 and a second receiving portion 466. In the present embodiment, both of the first receiving portion 462 and the second receiving portion 466 are openings piercing the second sidewall portion 460 in the lateral direction. However, the present invention is not limited thereto. The first receiving portion 462 and the second receiving portion 466 may be recess portions formed in an inner surface of the second sidewall portion 460 and dented outward in the lateral direction.

Figure 8:
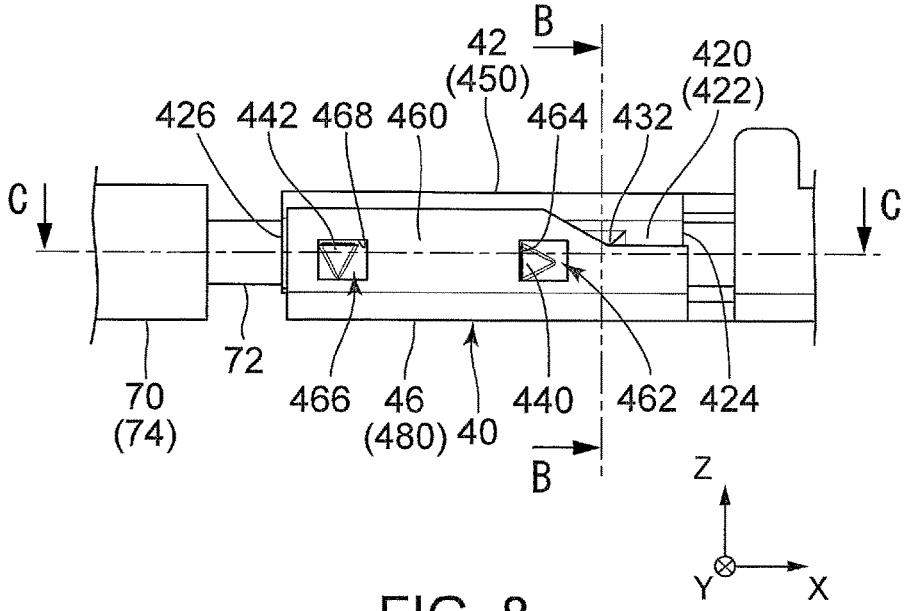
FIG. 8 is a side view showing the wire connection portion of the terminal included in the harness of FIG. 1.

As understood from FIGS. 8 and 10, the first receiving portion 462 and the second receiving portion 466 which are formed in each of the second sidewall portions 460 correspond to the first coming-off prevention protrusion 440 and the second coming-off prevention protrusion 442 which are provided to each of the first sidewall portions 420, respectively. When the wire connection portion 40 is in the closed state, the first receiving portion 462 receives the first coming-off prevention protrusion 440 corresponding thereto while the second receiving portion 466 receives the second coming-off prevention protrusion 442 corresponding thereto. In other words, when the wire connection portion 40 is in the closed state, the first coming-off prevention protrusion 440 enters the first receiving portion 462 corresponding thereto at least in part while the second coming-off prevention protrusion 442 enters the second receiving portion 466 corresponding thereto at least in part.

As shown in FIG. 8, the first receiving portion 462 has a first edge 464 perpendicular to the front-rear direction. The first edge 464 is located rearward of the first coming-off prevention protrusion 440 in the front-rear direction and prevents the first coming-off prevention protrusion 440 from being moved rearward. Hence, rearward movement of the first part 42 with respect to the second part 46 is prevented. That is, when the terminal 20 receives a force directed rearward from the electrical wire 70, the force is distributed to the first part 42 and the second part 46. On the other hand, the second receiving portion 466 has a second edge 468 perpendicular to the up-down direction. The second edge 468 is located upward of the second coming-off prevention protrusion 442 in the up-down direction and prevents the second coming-off prevention protrusion 442 from being moved upward. Hence, upward movement of the first part 42 with respect to the second part 46 is prevented. That is, even if the terminal 20 receives a force to shift the wire connection portion 40 into the open state from the electrical wire 70, the wire connection portion 40 can be maintained in the closed state. Additionally, in order to cope with a stronger force, it is preferable to dispose the second coming-off prevention protrusion 442 and the second receiving portion 466 near the rear end 426.

Figure 7:
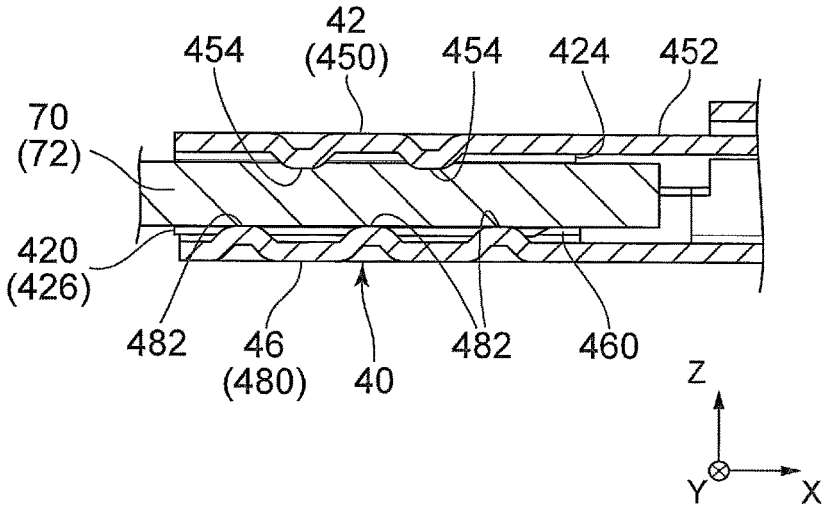
FIG. 7 is a cross-sectional view showing the wire connection portion of the terminal of FIG. 6. The wire connection portion is closed, and the tip portion of the core wire is sandwiched by a first part and the second part.

Referring to FIGS. 6 and 7, the first coupling portion 450 is formed with two first pressers 454, and the second coupling portion 480 is formed with three second pressers 482. In the present embodiment, the first pressers 454 and the second pressers 482 are formed by making slits into the metal plate and carrying out metal stamping for the metal plate. When the wire connection portion 40 is in the closed state, the first pressers 454 protrude downward in the up-down direction while the second pressers 482 protrude upward in the up-down direction. The first pressers 454 and the second pressers 482 are arranged in a staggered arrangement in the front-rear direction. As shown in FIG. 7, when the wire connection portion 40 is in the closed state, the tip portion of the core wire 72 is sandwiched by the first pressers 454 and the second pressers 482 in the up-down direction. However, the first pressers 454 and the second pressers 482 are not essential. Nevertheless, the first pressers 454 and the second pressers 482 regulate or prevent movement of the core wire 72 in the up-down direction and stabilize the connection state of the electrical wire 70 when the electrical wire 70 is connected to the wire connection portion 40. Accordingly, it is preferable to provide the first coupling portion 450 and the second coupling portion 480 with the first pressers 454 and the second pressers 482, respectively.

As shown in FIG. 6, assuming that the tip portion of the core wire 72 of the electrical wire 70 is put in the second part 46. Upon shifting the connection portion 40 into the closed state by moving the first part 42 toward the second part 46 from the state shown in FIG. 6, the electrical wire 70 is connected and fixed to the terminal 20. At this time, as shown in FIGS. 9 and 10, the protruding contact portions 430 sandwich the core wire 72 in the lateral direction. In other words, when the electrical wire 70 is connected to the terminal 20, the protruding contact portions 430 sandwich the core wire 72 in the lateral direction. Thus, electrical connection is established between the core wire 72 of the electrical wire 70 and the wire connection portion 40. Here, a surface of the core wire 72 is slightly deformed. However, the protruding contact portions 430 have some resilience, and therefore this contact does not damage the core wire 72 deeply. Moreover, the damage is very slight in comparison with a case where edges of metal plates are used as described in Patent Document 1. As just described, the protruding contact portions 430 do not damage the core wire 72 deeply. Accordingly, in a case where the surface of the core wire 72 is plated, the plating can be maintained to achieve better electrical connection. In order to achieve a stable contact state and good electrical connection, it is preferable that a size of the protruding contact portions 430 in the front-rear direction be larger than a board thickness of the first part 42. Incidentally, the size of the protruding contact portions 430 in the front-rear direction can be known from contact marks, which are formed and left on the core wire 72 by connecting the electrical wire 70 to the terminal 20 once and then detaching the electrical wire 70 from the terminal 20. These contact marks can be distinguished from other damages, which are formed on the surface of the core wire 72 by the lugs 436 and 438, on the basis of their shapes and depth. By regarding a length of the contact marks in the front-rear direction as the size of the protruding contact portions 430, the size of the protruding contact portions 430 in the front-rear direction can be known. As described above, if the protruding contact portions 430 are formed so that the size of the contact marks in the front-rear direction is larger than the board thickness of the first part 42, the aforementioned stable contact state and the aforementioned better electrical connection can be realized.

According to the present embodiment, the terminal 20 can be connected to the electrical wire 70 without using the pressure-contact blades of Patent Document 1. In other words, the terminal 20 does not need plate portions each of which extends in the lateral direction to be connected to the electrical wire 70. Therefore, the terminal 20 can be downsized in the lateral direction. In addition, according to the present embodiment, the size of the protruding contact portions 430 is larger than the board thickness of the first part 42. Therefore, the depth of the damage left on the core wire 72 can be shallower in comparison with the case of using the pressure-contact blades of Patent Document 1, and a contact area can be enlarged. Hence, the stable contact state and the better electrical connection can be achieved.

Although the specific explanation about the present invention is made above referring to the embodiments, the present invention is not limited thereto. For example, although the first coming-off prevention protrusions 440 and the first receiving portions 462 are provided to the first part 42 and the second part 46, respectively, in the aforementioned embodiment, the first coming-off prevention protrusions 440 and the first receiving portions 462 may be modified to be provided to the second part 46 and the first part 42, respectively. In that modification, the first edge 464 of each of the first receiving portions 462 is located forward of the first coming-off prevention protrusion 440 corresponding thereto in the front-rear direction when the wire connection portion 40 is in closed state. Similarly, the second coming-off prevention protrusions 442 and the second receiving portions 466 may be modified to be provided to the second part 46 and the first part 42, respectively. In that modification, the second edge 468 of each of the second receiving portions 466 is located downward of the second coming-off prevention protrusion 442 corresponding thereto in the up-down direction when the wire connection portion 40 is in closed state. Thus, it is sufficient that either one of the first part 42 and the second part 46 is provided with the first coming-off prevention protrusions 440 while the other is provided with the first receiving portions 462. In each modification, the first edge 464 of each of the first receiving portions 462 is required to be located forward of or rearward of the first coming-off prevention protrusion 440 corresponding thereto in the front-rear direction to prevent the first part 42 from being moved rearward with respect to the second part 46. Similarly, it is sufficient that either one of the first part 42 and the second part 46 is provided with the second coming-off prevention protrusions 442 while the other is provided with the second receiving portions 466 for receiving the second coming-off prevention protrusions 442. In each modification, the second edge 468 of each of the second receiving portions 466 is required to be located upward of or downward of the second coming-off prevention protrusion 442 corresponding thereto in the up-down direction to prevent the first part 42 from being moved apart from the second part 46.

In addition, although the core wire 72 of the electrical wire 70 is the single wire in the aforementioned embodiment, the core wire 72 may be a stranded wire. If a stranded wire is used, any binder, such as a sheath, binding the stranded wire may be provided on parts of the stranded wire to prevent the stranded wire from coming loose or being deformed at a time when the electrical wire 70 is connected to the terminal 20, wherein the parts of the stranded wire are positioned frontward of and rearward of areas brought into contact with the protruding contact portions 430. Nevertheless, in order to achieve sufficient contact pressure to the protruding contact portions 430, it is preferable that the core wire 72 be the single wire.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A terminal to be connected to an electrical wire, wherein:

the terminal has a terminal body connectable to a mating terminal and a wire connection portion to be connected to the electrical wire;

the wire connection portion is located rearward of the terminal body in a front-rear direction;

the wire connection portion has a first part and a second part;

the first part has two first sidewall portions and a first coupling portion;

the first sidewall portions are located apart from each other in a lateral direction perpendicular to the front-rear direction;

the first coupling portion couples the first sidewall portions to each other;

the second part has two second sidewall portions and a second coupling portion;

the second sidewall portions are located apart from each other in the lateral direction;

the second coupling portion couples the second sidewall portions to each other;

the second sidewall portions are located outward of the first sidewall portions, respectively, in the lateral direction;

the first coupling portion is located apart from the second coupling portion in an up-down direction perpendicular to both of the front-rear direction and the lateral direction;

the first sidewall portions are provided with contact portions, respectively, to be brought into contact with the electrical wire;

the terminal is made of a single thin metal plate, and the terminal body and the wire connection portion are formed in a single body;

the first part has a bending portion;

the bending portion is configured to allow the first part and the second part to move with respect to each other by deforming of the bending portion; and when the electrical wire is connected to the terminal, the contact portions sandwich the electrical wire in the lateral direction.

2. The terminal as recited in claim 1, wherein:

each of the first sidewall portions has a main portion of a flat shape; and each of the contact portions comprises a part of the main portion or a protruding contact portion protruding inward in the lateral direction from the main portion.

3. The terminal as recited in claim 2, wherein:

the contact portions have a size in the front rear direction;

the first part has a board thickness; and the size of the contact portions is larger than the board thickness of the first part.

4. The terminal as recited in claim 2 or 3, wherein:

at least one of the first sidewall portions is provided with the protruding contact portion as the contact portion; and the protruding contact portion is formed by metal stamping.

5. The terminal as recited in claim 4, wherein the protruding contact portion comprises a curved surface curved with respect to the up-down direction.

6. The terminal as recited in claim 4, wherein the protruding contact portion comprises a curved surface curved with respect to the front-rear direction.

7. The terminal as recited in claim 1, wherein the first sidewall portions are further provided with holding portions, respectively, to hold the electrical wire.

8. The terminal as recited in claim 1, wherein:

either one of the first part and the second part is provided with a first coming-off prevention protrusion;

a remaining one of the first part and the second part is provided with a first receiving portion which receives the first coming-off prevention protrusion;

the first receiving portion comprises a first edge perpendicular to the front-rear direction; and the first edge is located forward of or rearward of the first coming-off prevention protrusion in the front-rear direction to prevent the first part from being moved rearward with respect to the second part.

9. The terminal as recited in claim 1, wherein:

either one of the first part and the second part is provided with a second coming-off prevention protrusion;

a remaining one of the first part and the second part is provided with a second receiving portion which receives the second coming-off prevention protrusion;

the second receiving portion comprises a second edge perpendicular to the up-down direction; and the second edge is located upward of or downward of the second coming-off prevention protrusion in the up-down direction to prevent the first part from being moved in a direction away from the second part.

10. A harness comprising the terminal as recited in claim 1 and the electrical wire.

* * * * *